US008863907B2

(12) United States Patent
Studer et al.

(10) Patent No.: US 8,863,907 B2
(45) Date of Patent: Oct. 21, 2014

(54) ELEVATOR WITH ROLLER-PINION DRIVE

(75) Inventors: Christian Studer, Lucerne (CH); Hans Kocher, Udligenswil (CH); Karl Weinberger, Immensee (CH); Thomas Neuenschwander, Zurich (CH)

(73) Assignee: Inventio AG, Hergiswil (CH)

( * ) Notice: Subject to any disclaimer, the term of this patent is extended or adjusted under 35 U.S.C. 154(b) by 506 days.

(21) Appl. No.: 13/117,609

(22) Filed: May 27, 2011

(65) Prior Publication Data

US 2011/0308893 A1 Dec. 22, 2011

(30) Foreign Application Priority Data

May 28, 2010 (EP) ..... 10164378

(51) Int. Cl.
*B66B 9/02* (2006.01)

(52) U.S. Cl.
CPC ..... *B66B 9/022* (2013.01)
USPC ..... 187/270

(58) Field of Classification Search
CPC ..... B66B 9/02; B66B 9/20
USPC ..... 187/236, 270, 250
See application file for complete search history.

(56) References Cited

U.S. PATENT DOCUMENTS

| | | | | | |
|---|---|---|---|---|---|
| 1,660,465 | A * | 2/1928 | Withrow | ..... | 414/233 |
| 4,269,285 | A * | 5/1981 | Ohkoshi et al. | ..... | 187/270 |
| 5,191,920 | A * | 3/1993 | McGregor | ..... | 141/313 |
| 5,452,774 | A * | 9/1995 | Davis et al. | ..... | 187/270 |
| 2007/0084672 | A1 | 4/2007 | Helmle et al. | | |
| 2008/0173501 | A1 * | 7/2008 | Ellison et al. | ..... | 187/270 |

FOREIGN PATENT DOCUMENTS

| | | | | | |
|---|---|---|---|---|---|
| JP | 49067356 | U | 6/1974 | | |
| JP | 51079273 | U | 6/1976 | | |
| JP | 54067979 | A * | 5/1979 | ..... | B65G 1/06 |
| JP | 59133570 | U | 9/1984 | | |
| JP | 8048477 | A | 2/1996 | | |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator has a car movable within a hoistway, a rack extending along the hoistway, the rack having a toothed profile with wave troughs and wave crests and a drive mounted in proximity to the rack so that the drive interacts with the rack to move the car. The drive includes a roller pinion unit fixedly mounted on a shaft and having a predetermined number of roller pinions arranged in a circle around the shaft and extending parallel to the shaft. The roller pinion unit interacts with the toothed profile of the rack. The drive also includes a motor unit configured to rotate the shaft. Optionally, the drive includes a brake unit configured to act on the shaft.

18 Claims, 10 Drawing Sheets

ELEVATOR WITH ROLLER-PINION DRIVE

CROSS-REFERENCE TO RELATED APPLICATION

This application claims priority to European Patent Application No. 10164378.1, filed May 28, 2010, which is incorporated herein by reference.

FIELD

The present disclosure relates to elevators and, more particularly, to elevators having a drive mechanism other than that employed in conventional systems where suspension members such as ropes or belts are driven by traction trough a traction sheave.

BACKGROUND

Certain elevators apply a drive mechanism based on a rack-and-gear system (also referred to as rack-and-gear elevators). A motor mounted on an elevator car drives a gear the teeth of which engage a toothed rack secured to a wall of an elevator shaft. Such a system is illustrated in WO-A1-2010/010023. Drawbacks of rack-and-gear elevators include noise generated when the gear teeth move along the rack and relatively poor ride comfort. For these reasons, rack-and-gear elevators are typically used in areas where noise and ride comfort are not critical such as the building industry or other industrial applications. For example, T. Grovatt and J. Tiner describe in "Rack-and-Pinion Gear-Drive System for Spires of Steel," Elevator World, September 2006, Vol. LIV, No. 9, pages 79-83, a dual pinion drive and an integral I-beam rail and rack system for use in outdoor broadcast towers.

Despite these drawbacks, a rack-and-pinion elevator does not need a drive machine located in an overhead space or a machine room. Further, a rack-and-gear elevator does not require a counterweight traveling along the elevator shaft. Rack-and-gear elevators, therefore, require less space than, for example, conventional traction elevators. For these reasons, rack-and-gear elevators are attractive for non-industrial uses.

SUMMARY

Some disclosed embodiments involve an elevator, having a car movable within a hoistway, a rack extending along the hoistway, the rack having a toothed profile with wave troughs and wave crests and a drive mounted in proximity to the rack so that the drive interacts with the rack to move the car. The drive includes a roller pinion unit fixedly mounted on a shaft and having a predetermined number of roller pinions arranged in a circle around the shaft and extending parallel to the shaft. The roller pinion unit interacts with the toothed profile of the rack. The drive also has a motor unit configured to rotate the shaft and a brake unit configured to act on the shaft.

The use of roller pinions can permit very smooth engagement of the pinion unit with and disengagement from the toothed profile of the rack and thereby noise is minimized. Furthermore, the pins of the pinion unit can be spaced to engage the rounded teeth of the rack in such a way that two or more pins engage the teeth in opposition at all times to efficiently transmit forces.

The drive can be mounted on top of the car or at its bottom. This can provide flexibility to the layout of the elevator; depending on particular requirements (e.g., with respect to space or car design. The drive's mounting can be selected according to these requirements.

The motor unit of the drive can be of gearless design. This further reduces the number of components within the drive and, consequently, can lead to reduced cost, space requirements and maintenance complexity. In addition, a gear as a source of noise can be reduced or eliminated.

In addition to the rack, certain embodiments of the elevator may have at least one guide rail that extends along the hoistway. The guide rail cooperates with a guide unit that engages the guide rail and secures the car's bottom or upper part to the guide rail. The guide unit may be adjustable in a direction perpendicular to the shaft wall to adjust a distance between the car and/or the drive and the shaft wall. This allows adjusting the force with which the pinion unit urges against the toothed rack.

In some cases, the guide rail and the rack can be integrally formed as a single element. Such an integrally formed mounting arrangement can facilitate the installation process because only a single piece needs to be installed. Further, the guide rail and the rack have a fixed position with respect to each other so that no alignment of these components is necessary during the installation process.

In one embodiment, the drive further includes rollers engaged with the rack. These rollers are positioned ahead and behind of the pinion unit along the rack. This arrangement improves the guidance of the drive along the rack. Furthermore, the rollers can be resilient and can thereby attenuate any noise caused by the interaction of pins of the pinion unit with the toothed profile of the rack from traveling along the rack.

In another embodiment, the elevator has two drives, each interacting with an independent rack, and a tension member interconnecting the drives wherein the car is supported by a pulley box on the tension member. This arrangement accommodates the significant differences in the tolerances for guiding the drive along the rack and that for guiding the car within the hoistway. The pulley box may be mounted either under or above the car.

Possibly, the car further has a clamp to selectively engage with and disengage from the tension member. Accordingly, in normal operation with the car clamped to the tension member the elevator is safe even if the tension member were to break or fracture at one side of the clamp; the drive at the other side of the clamp would support the car at its position in the hoistway.

In an alternative embodiment, the elevator has two drives, each interacting with an independent rack, wherein the car is resiliently supported on each drive. This arrangement can allow for the inherent small changes in the relative lateral position of between the drives and the car as the elevator travels upwards and downwards within the hoistway. Such a system may include a resilient element and a slide bearing between the car and each drive. Alternatively, a damper can be used to interconnect the car and each drive.

Another aspect involves a method of operating an elevator having two drives each interacting with an independent rack to support the car, wherein if the elevator becomes trapped between two floors, the car is evacuated by releasing a brake of a selected one of the drives. Possibly, the method includes the subsequent step of re-engaging the brake of the selected one of the drives and the releasing the brake on the other drive and repeating this alternate sequence if necessary. This procedure of releasing and engaging the brake units on alternate drives enables the car to be gradually lowered under gravity until it reaches a lower floor when any passengers can alight. The method may further comprise the steps of providing a tension member interconnecting the drives, supporting the car by a pulley box on the tension member and selectively clamping the car to the tension member by a clamp. In this situation, evacuation can take place by releasing the clamp. Accordingly, the selected drive will move downwards under the force of gravity and the car, which is now freely movable via the pulley box along the tension member, will also gradually travel downwards. Again, once the car is positioned adjacent to a floor the brake unit is reapplied to stop the car and thereafter passengers are permitted to exit the car. Optionally, in addition to releasing its brake unit, the motor unit of the selected drive could be driven at half speed.

An elevator having a drive mechanism other than that employed in conventional systems where suspension members such as ropes or belts are driven by traction trough a traction sheave, can have a plurality of beneficial effects. With respect to the building, an elevator with roller-pinion based drive can have an improved hoistway use in that it requires less space for headroom and pit, and can be operated without a counterweight and without a buffer in the pit. Further, the rack or any guide rails may be mounted on an inclined hoistway wall allowing additional design options.

With respect to the installation process, the elevator may be installed without scaffolding; the installation is a bottom-up installation so that initially installed rack and guide elements and the car are used to install and connect subsequent rack and guide elements. For that process, the fitter may stand on the roof of the car. In addition, the installation can be improved due to a higher degree of pre-fabrication. That is, for example, as the motor is no longer mounted in a machine room or in the shaft's head room, the motor may be factory-mounted on the roof component of the car, which roof component is then delivered to the installation site. Alternatively, the whole car may be factory-assembled with the motor mounted to the car, and the whole car is then delivered to the site; a crane may then lift the car into the shaft.

With respect to the operation of the elevator, the roller-pinion based drive provides for an improved ride comfort due to fewer vibrations caused when the pinions interact with the rack's toothed profile. Any vibrations may be attenuated by resilient rollers that contact the rack and travel with the drive. Further, the drive and the rack may be used as part of a hoistway (position) information system. For example, the system may be calibrated so that an incremental encoder synchronously rotates with the pinion unit as it moves along the rack to thereby provide a highly accurate indication of the position of the car within the hoistway. This information can be used by an elevator control to determine the best possible travel curves for executing trip requests made by the passengers.

With respect to maintenance, at least some of the disclosed embodiments can offer advantages with respect to the conventional traction-based systems. Firstly, during maintenance, the drive can be effectively locked in position within the hoistway through the positive engagement of the pins of the pinion unit and the toothed profile of the rack, thereby ensuring that the car will not move when maintenance technicians are carrying out routine procedures within the hoistway. Since there are fewer components within the hoistway (no counterweight or traction rope), there can be better access to the hoistway for the maintenance personnel and once inside the hoistway more maneuverability. Furthermore, since the drive is not mounted at the top of the elevator hoistway, the technicians no longer need to travel on the roof of the car to the top of the hoistway in order conduct the required maintenance operations on the drive.

Since an elevator as described herein does not require a counterweight, the designer can make more effective and efficient use of the hoistway space to greatly improve use and capacity of the elevator. Additionally, since both the car and the drive travel along the entire hoistway, the replacement of these components is simplified.

In at least some embodiments, safety of the elevator can be improved since the drive can always be in positive engagement with the toothed profile of the rack. Additionally, since at least some embodiments do not employ the traditional traction ropes it can be much safer in a fire situation compared to conventional traction elevators. In the embodiments of the elevator that utilize two racks and two drives, safety can be further enhanced by the inherent redundancy of the elevator.

BRIEF DESCRIPTION OF THE DRAWINGS

The disclosed embodiments are best understood by reference to the detailed description, which follows, when read in conjunction with the accompanying drawings, wherein.

DETAILED DESCRIPTION

Figure 1:
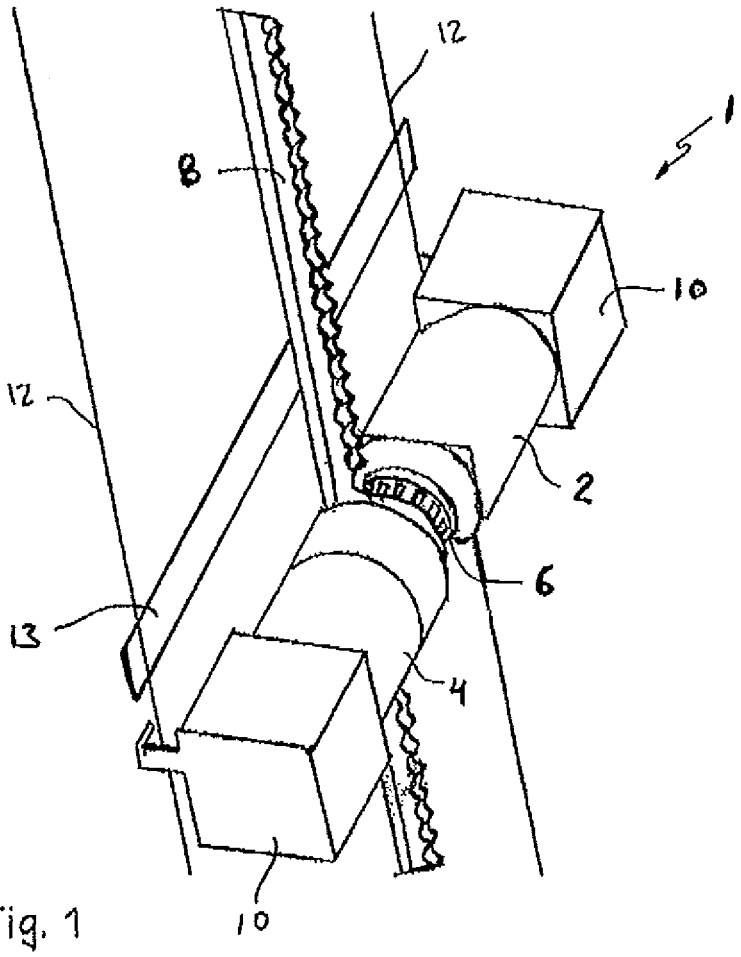
FIG. 1 shows a schematic illustration of one embodiment of a pinion based drive system configured to be mounted to a car of an elevator.

FIG. 1 schematically illustrates a perspective view of one embodiment of a pinion-based drive 1 configured to be mounted to a car of an elevator. The elevator may be installed in any kind of building, whether residential, industrial or commercial. Within a multi-story building, the car moves within a shaft or hoistway between floors of the building to transport people and/or goods from one floor to another. The hoistway, i.e., the space in which the car travels, may be formed by four or less walls. The elevator may even be a so-called panoramic elevator having a car with at least one transparent side wall made of, for example, glass. For ease of illustration, FIG. 1 does not show the car, shaft details or any control equipment.

The drive 1 of FIG. 1 includes a motor unit 2, a brake unit 4 and a pinion unit 6 mounted on a drive shaft (not visible in FIG. 1) serving as a rotational axis of the pinion unit 6. In at least some embodiments, the motor unit 2 may be any type of motor as long as certain requirements are met; for example, the motor should be lightweight, efficient, silent and cause minimum vibrations. Known types of motors that meet these requirements are permanent-magnet motors or brushless DC (BLDC) motors, which have high power densities. In the illustrated embodiment, the motor unit 2 is of gearless design.

In the illustrated embodiment, the pinion unit 6 is positioned between the motor unit 2 and the brake unit 4. The motor unit 2 acts upon the drive shaft to rotate the pinion unit 6 about the rotational axis. Similarly, the brake unit 4 acts upon the drive shaft to control a rotational speed of the drive shaft, e.g., to reduce the rotational speed until it stops. In addition, the brake unit 4 keeps the car in a standstill, e.g., at a floor to allow passengers to board or exit the car. Each one of the motor unit 2 and the brake unit 4 is connected to a mounting unit 10 that couples the drive 1 to the car and a guide rail 12. In one embodiment, the guide rails 12 are fixed to a hoistway wall and extend vertically along that hoistway wall.

The elevator includes a rack 8 mounted to the shaft wall between the guide rails 12 so that the rack 8 extends substantially parallel to the guide rails 12. The guide rails 12 and the rack 8 are aligned with respect to each other along the hoistway so that the rack 8 has on each side a predetermined distance to the respective guide rails 12. To facilitate alignment of these components, a mounting bar 13 may be used that is mounted horizontally to the hoistway wall, as shown in FIG. 1. The mounting bar 13 has predetermined locations for attaching the guide rails 12 and the rack 8. This can assure that the guide rails 12 and the rack 8 have the desired spacing along the hoistway.

As illustrated in FIG. 1, the pinion unit 6 of the drive 1 engages with the rack 8 having a toothed profile. Upon activation by the motor unit 2, the pinion unit 6 rotates about its rotational axis and interacts with the rack 8 to move the car up or down. It is contemplated that the drive 1 is coupled to a control unit (not shown) of the elevator to receive control signals (e.g., to activate the motor unit 2 and the brake unit 4) from the control unit, and—depending on a particular implementation—to send status signals back to the control unit.

Figure 2:
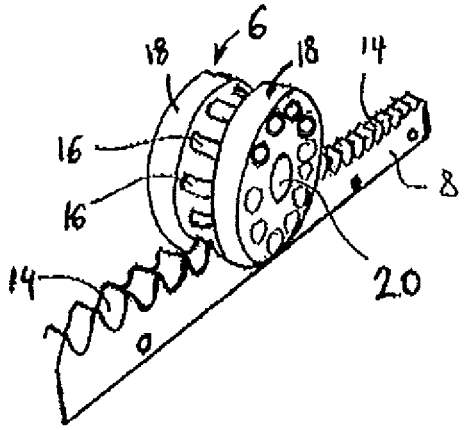
FIG. 2 is a schematic illustration of one embodiment of a pinion unit in cooperation with a rack having a toothed profile.

FIG. 2 is a schematic illustration of one embodiment of the pinion unit 6 shown to cooperate with a section of the rack 8. The pinion unit 6 has two parallel discs 18 spaced at a predetermined distance, and a number of pins 16 secured to the discs 18 and extending between the discs 18 to form a ring of spaced pins 16. The discs 18 are, hence, bearings that support the pins 16. A central opening in both discs 18 receives the drive shaft that connects to the motor unit 2 and the brake unit 4. In one embodiment, the pinion unit 6 includes a roller pinion system available from Nexen Group, Inc., USA.

The rack 8 has a particular toothed profile 14 with teeth forming wave troughs and wave crests. Unlike a rack for a conventional rack-and-pinion system that has neighboring pointed teeth joining at an acute angle, the rack 8 has rounded-peak teeth (each forming a wave crest) that are joined via concave transition zones (each forming a wave trough), as schematically shown in FIGS. 1 and 2. The radius of the pins 16 corresponds to the minimum radius of the concave transition zones. Furthermore, in at least some embodiments, the pins 16 of the pinion unit 6 are spaced to engage the rounded teeth of the rack 8 in such a way that two or more pins 16 engage the teeth in opposition at all times and efficiently transmit forces. During that interaction, the rotary motion of the pinion unit 6 is transformed to a translatory motion of the entire drive 1 along the rack 8.

Figure 3:
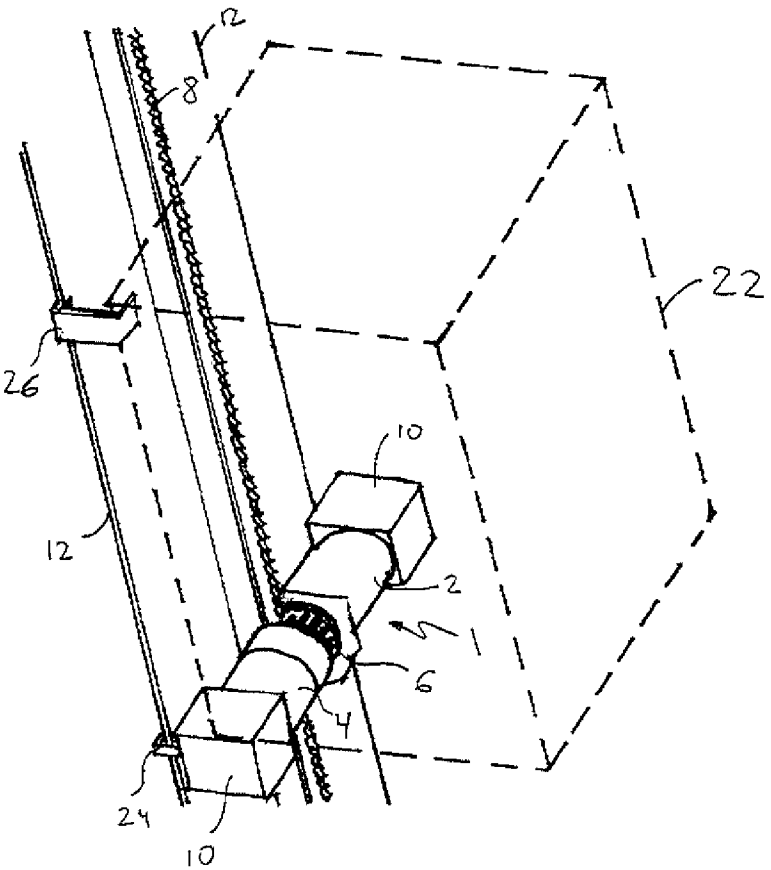
FIG. 3 is a schematic illustration of one embodiment of an elevator with a drive system of FIG. 1 being mounted to a bottom part of a car.
Figure 4:
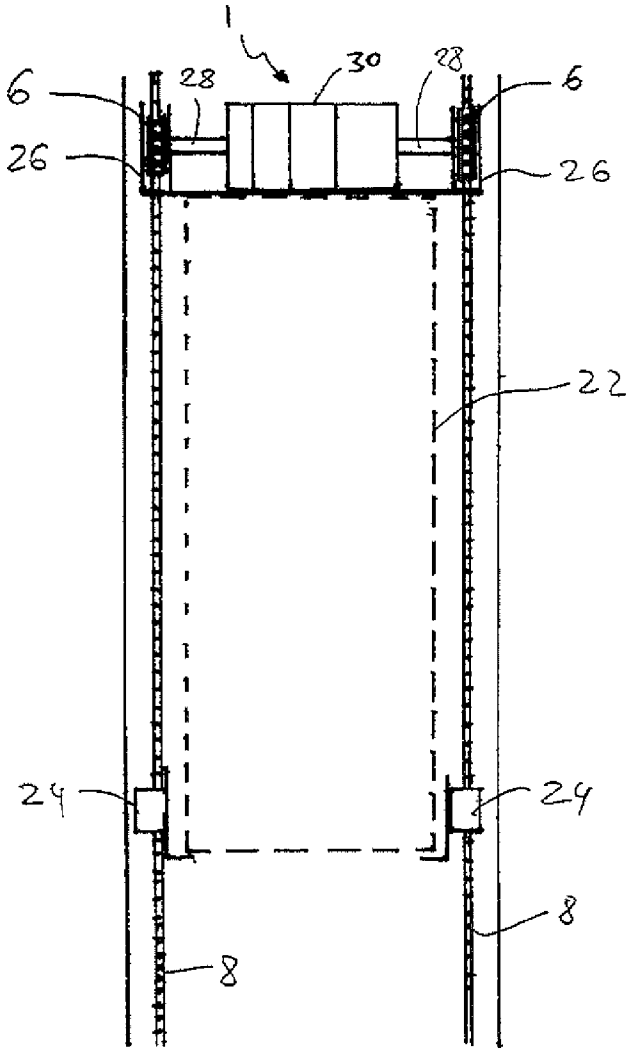
FIG. 4 is a schematic illustration of one embodiment of an elevator with a modified drive system being mounted on top of a car.

FIGS. 3 and 4 illustrate embodiments of an elevator including a pinion-based drive 1 mounted either directly or by means of resilient supports to a car 22 and, as such, travels with the car 22 as it moves. In these embodiments, the elevator is configured as a "rucksack" elevator wherein the car 22 is guided along only on a single side of the car 22. Possibly, the car's three remaining sides are available for mounting a car door and, optionally, glass walls for a panoramic elevator. An architect, for example, has an additional degree of freedom for positioning the car door.

Referring to FIG. 3, which is a perspective view of one embodiment of an elevator, the drive 1 of FIG. 1 is mounted to a bottom part of the car 22 towards the car's back side so that the pinion unit 6 engages the rack 8. The rack 8 has a toothed profile, as shown in FIG. 2. It is contemplated that in another embodiment, the drive 1 may be mounted to the car 22 at any other suitable place as long as the pinion unit 6 may engage the rack 8. For example, the drive 1 may be mounted on top of the car 22, again, towards the car's back side. In yet another embodiment, the drive 1 may be mounted directly onto the back side of the car 22.

Each mounting unit 10 of the drive 1 has a guide unit 24 that engages the guide rail 12 and secures the car's bottom part to the guide rail 12. Additional guide units 26 (only one is shown in FIG. 3) at an upper part of the car 22 secure the car's upper part to the guide rails 12. In one embodiment, the guide units 24, 26 may be adjustable in a direction perpendicular to the shaft wall to adjust a distance between the car 22 and/or the drive 1 and the shaft wall. In another embodiment, the guide units 24, 26 may be selectively mountable at the car 22 or the mounting unit 10 to set a predetermined distance. These embodiments allow adjusting the force with which the pinion unit 6 urges against the toothed rack 8. As such, the guide units 24, 26 not only guide and secure the car 22 along the guide rails 12 but also ensure that the pinion unit 6 exerts an optimized pressure against the rack 8.

In the embodiment of FIG. 4, a modified drive 1 is mounted on top of the car 22 towards the car's back side. This modified drive 1 has two pinion units 6, a drive shaft 28, and a combined motor and brake unit 30. The combined motor and brake unit 30 is positioned at an intermediate position of the drive shaft 28 between the two pinion units 6. In one embodiment, the drive shaft 28 extends along a central longitudinal axis through the combined motor and brake unit 30, wherein the combined motor and brake unit 30 acts upon the drive shaft 28 to rotate both pinion units 6. In another embodiment, the drive shaft 28 may be a two part element, each element being connected to one of the pinion units 6, and independently controlled by the combined motor and drive unit 30.

As shown in FIG. 4, the pinion units 6 engage two toothed racks 8. Each rack 8 has teeth that are configured as shown in FIG. 2, and described above. In addition to their function of transmitting forces between the pinion units 6 and the racks 8, each rack 8 has the function of guiding the drive unit 1. Additional guide rails, such as the guide rails 12 shown in FIG. 3, are not necessary in this embodiment. The guide units 24, 26 engage the racks 8 and secure the car 22 to the racks 8, wherein the guide units 24 secure the car's bottom part and the guide units 26 the car's upper part. Similar to the embodiment of FIG. 3, the guide units 24, 26 may be adjustable in a direction perpendicular to the shaft wall to adjust the distance between the car 22 and/or the drive 1 and the shaft wall, e.g., to ensure that the pinion units 6 exert an optimized pressure against the racks 8.

Figure 5A:
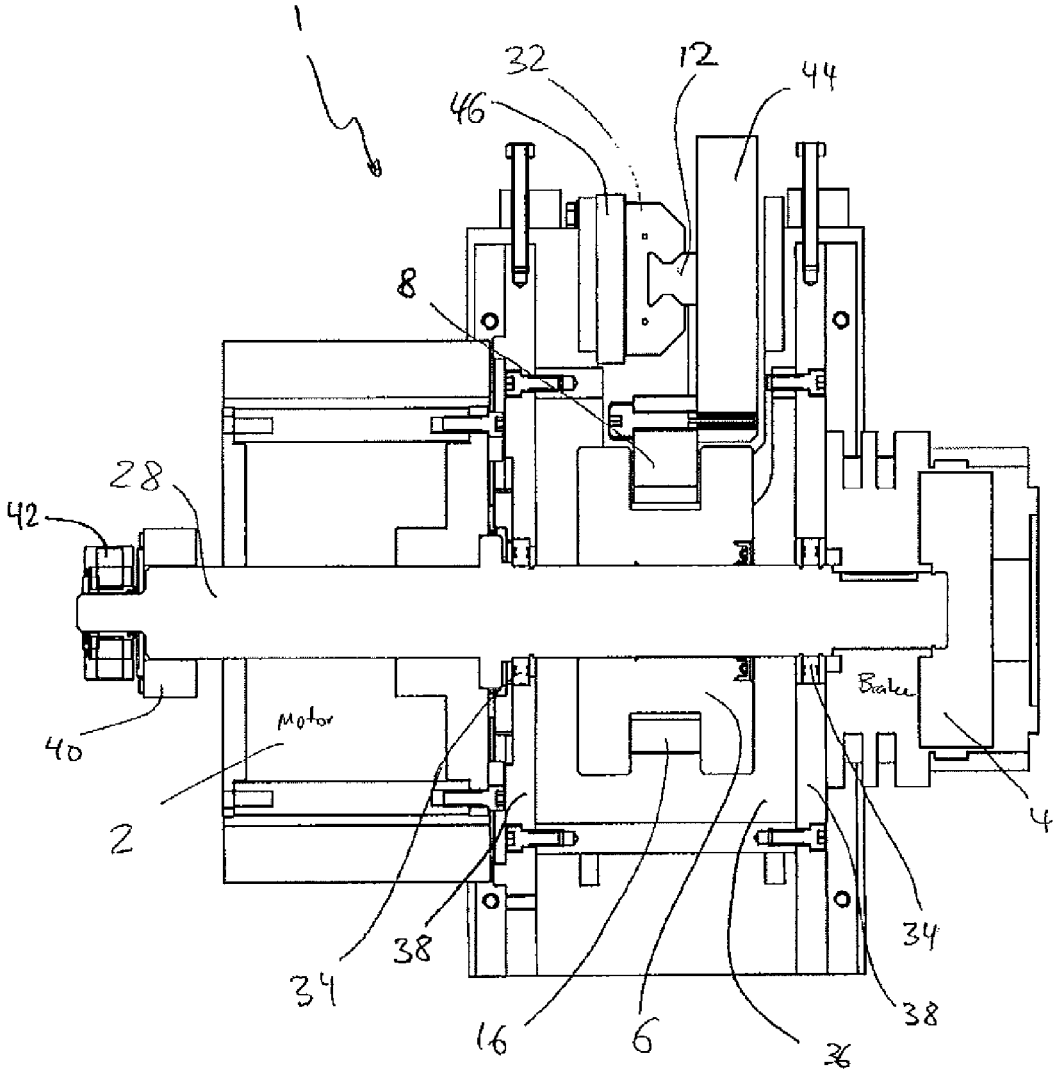
FIG. 5*a* is a cross-sectional view along a horizontal plane of one embodiment of a roller-pinion based drive system.

FIG. 5*a* is a cross-sectional view of one embodiment of a drive 1 in engagement with a guide rail 12 and a rack 8. The cross-section shows a horizontal plane extending along a longitudinal axis of the shaft 28. The drive 1 has a support structure 36 that houses the pinion unit 6 in such a way that the pinion unit 6 can interact with the vertically extending rack 8. The brake unit 4 is mounted to one side of the support structure 36, and the motor unit 2 is mounted to the other side of the support structure 36. The mounting may be via screws to allow removing the brake unit 4, or the motor unit 2, or both, e.g., for service or replacement.

The support structure 36 has two bearings 34 located in opposite parallel walls 38, wherein the bearings 34 rotatably support the shaft 28. The shaft 28 extends through the bearings 34 in a direction that is perpendicular to the walls 38. As the pinion unit 6 is fixedly mounted on the shaft 28, the bearings 34 also rotatably support the pinion unit 6 positioned between the bearings 34.

Further, the shaft 28 extends through the motor unit 2 and is supported at an end section by a bearing 40. A fastener 42 secures the shaft 28 to the bearing 40. The shaft 28 also extends through the brake unit 4, wherein the other end section of the shaft 28 ends within the brake unit 4.

FIG. 5*a* shows further a guide element 32 (also referred to as guide shoe) secured to the drive 1 via a connecting element 46. As such, the guide element 32 and the connecting element 46 may be viewed as integral parts of the drive 1, or as separate parts mounted to the drive 1. The guide element 32 has a generally C-shaped cross-section with a base (mounted to the connecting element 46) and two lugs extending from the base and configured to engage the guide rail 12. The guide rail 12 has a profile that corresponds to the C-shaped cross-section of the guide element 32 so that the lugs partially embrace an end section of the profiled guide rail 12.

In the embodiment shown in FIG. 5*a*, the guide rail 12 and the rack 8 are mounted to a base structure 44. That is, unlike in the embodiments of FIGS. 1 *and* 3, the guide rail 12 and the rack 8 are not individually mounted to a wall of the hoistway, but the base structure 44 is mounted to the wall. This facilitates easier installation of the elevator because, e.g., as the guide rail 12 and the rack 8 are both mounted to the base structure 44 no alignment of these components to each other is necessary.

Figure 7:
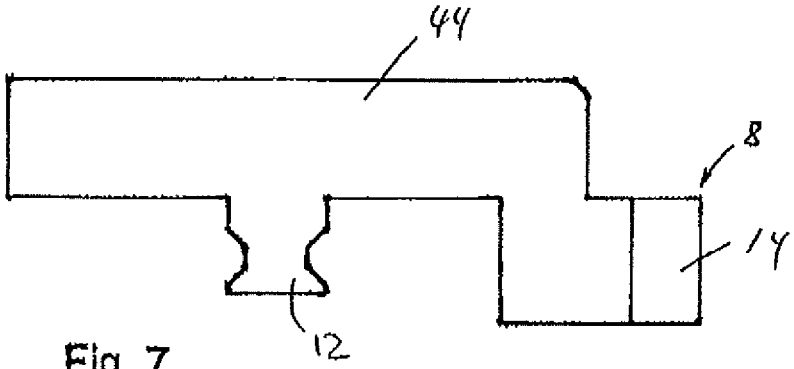
FIG. 7 is an illustration of one embodiment of a guide rail and rack arrangement.
Figure 8:
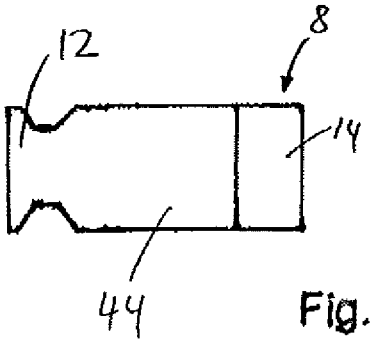
FIG. 8 is an illustration of one embodiment of another guide rail and rack arrangement.
Figure 9:
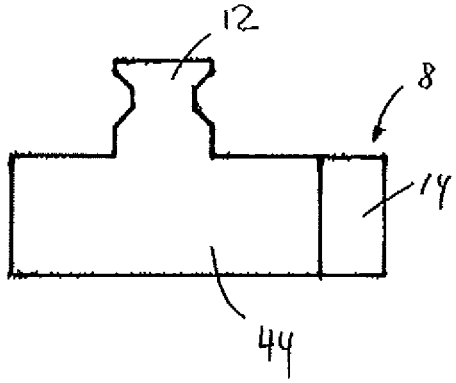
FIG. 9 is an illustration of one embodiment of yet another guide rail and rack arrangement.

The base structure 44, the guide rail 12 and the rack 8 extend vertically in the hoistway. Further, the base structure 44 extends parallel to the walls 38 of the support structure 36 between an outer side (towards the hoistway wall) and an inner side (towards the pinion unit 6). In the illustrated embodiment of FIG. 5, the rack 8 is arranged at the inner side of the base structure 44, and the guide rail 12 is arranged approximately half way between the inner side and the outer side. Other mounting arrangements of the guide rail 12 and the rack 8 are shown in FIGS. 7-9.

Figure 5B:
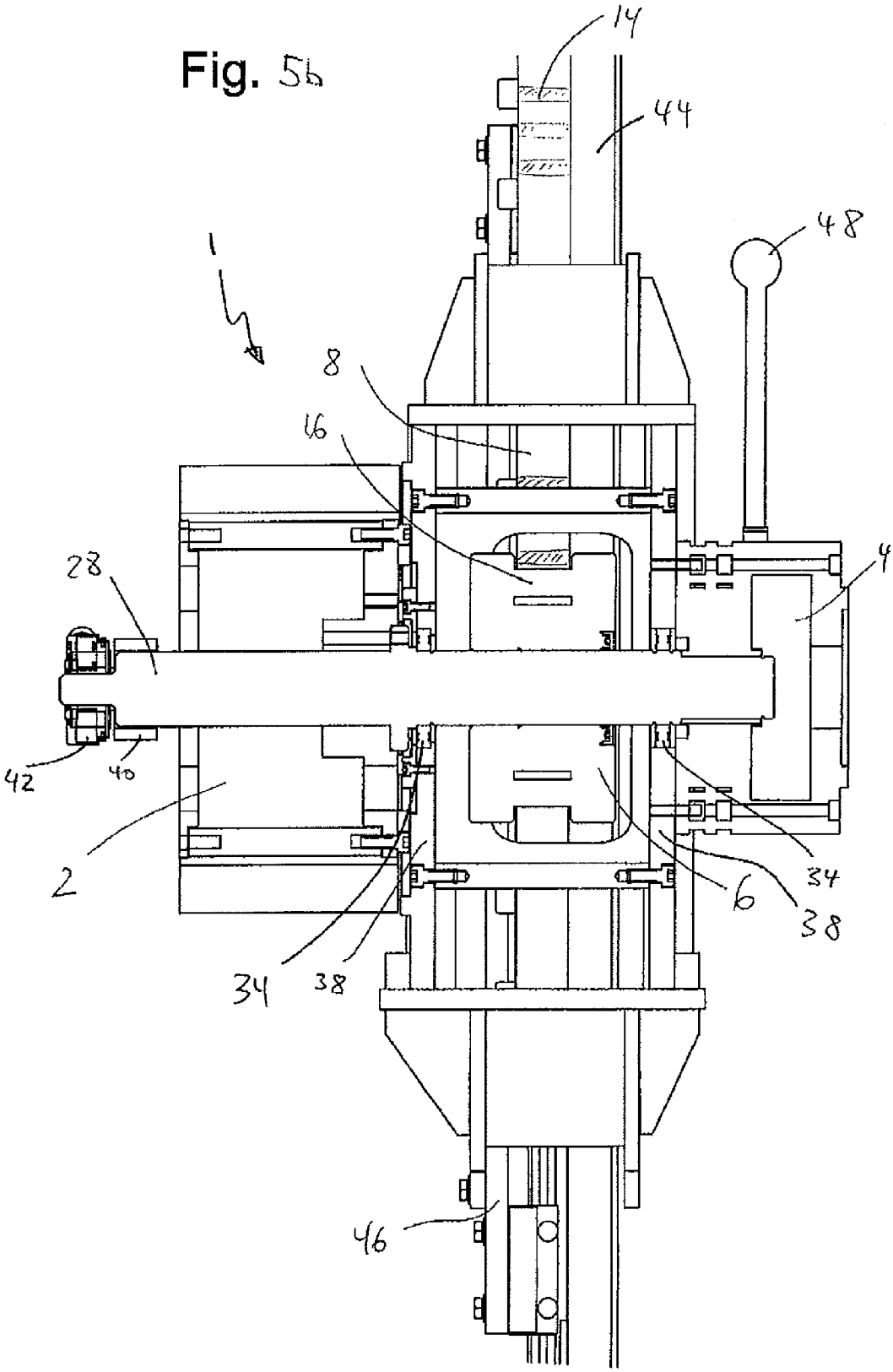
FIG. 5*b* is a cross-sectional view along a vertical plane of the embodiment of FIG. 5*a;*

FIG. 5*b* is a cross-sectional side view along a vertical plane of one embodiment of the roller-pinion based drive system shown in FIG. 5*a*. In addition to the components mentioned with reference to FIG. 5*a*, the drive 1 includes a lever 48 coupled to the brake unit 4. This lever 48 allows manual de-activation of the brake unit 4, e.g., during installation and commissioning of the elevator.

In FIG. 5*b*, the various vertically extending components, i.e. rack 8 (with indicated toothed profile 14), base structure 44 and connecting element 46, are visible. These components are arranged in proximity of the hoistway wall so that, with reference to these components, the better part of the drive system 1 faces away from these components. This can permit mounting the drive system 1 as close a possible to the hoistway wall, with the better part overlapping with the car floor or roof, to minimize space requirements, as indicated in FIG. 3.

Figure 6:
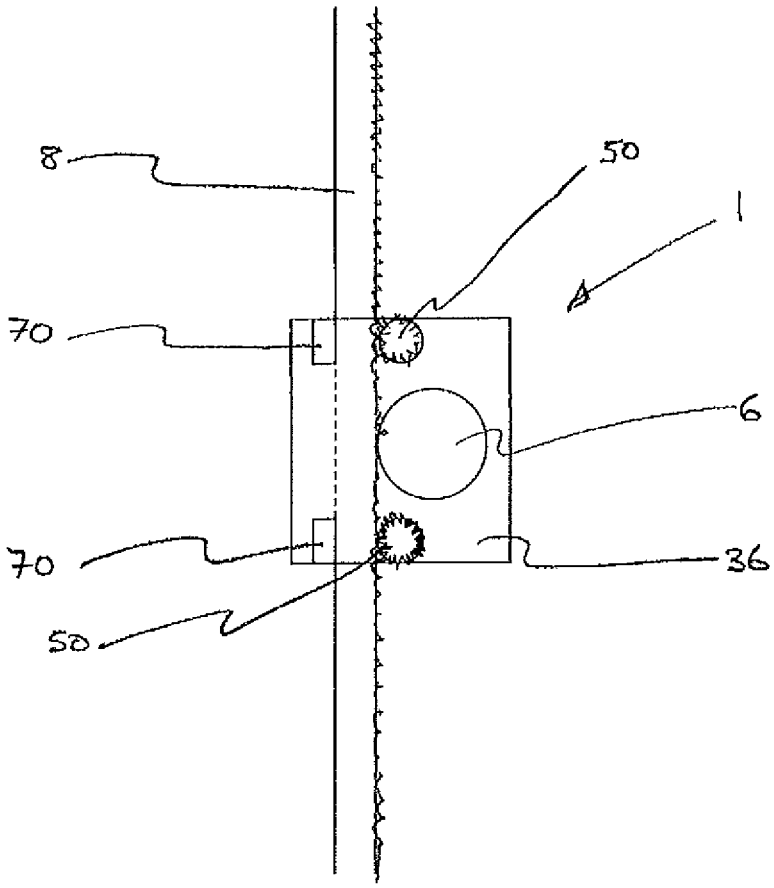
FIG. 6 is a schematic plan view along a vertical plane of one embodiment of a roller-pinion based drive system.

FIG. 6 is a cross-sectional schematic side view of one embodiment of the roller-pinion based drive shown in FIGS. 5*a* and 5B. In addition to the components mentioned with reference to FIG. 5, the support structure 36 of drive 1 further includes a resilient toothed roller 50 mounted above the pinion unit 6 and another resilient toothed roller 50 mounted below the pinion unit 6. Each of the toothed rollers 50 is accompanied by an associate guide element 70 positioned on the opposite side of the rack 8 to ensure the toothed roller 50 is pressed into engagement with the corresponding toothed profile of the rack 8. The rollers 50 can be resilient so that they attenuate at least some noise and vibration caused by the engagement of the pins 16 of the pinion unit 6 with the toothed profile 14 of the rack 8 from traveling along the rack 8. Possibly, the associated guide elements 70 are also manufactured at least partially from resilient material such as rubber or a comparable plastic.

FIGS. 7-9 schematically illustrate various mounting arrangements of the guide rail 12 and the rack 8. For ease of illustration, a guide element that engages the guide rail 12 is not shown. The arrangement of FIG. 7 corresponds in principle to the arrangement shown in FIG. 5, however, the guide rail 12, the base structure 44 and the rack 8 (with its toothed profile 14) are integrally formed so that a single piece results.

As shown in FIGS. 8 and 9, the guide rail 12, the base structure 44 and the rack 8 (with its toothed profile 14) are also integrally formed so that a single piece results, but the guide rail 12 and the rack 8 are arranged differently with respect to the base structure 44. The base structure 44 has a generally rectangular cross-section. In FIG. 8, the guide rail 12 and the rack 8 are arranged on opposing sides of the base structure 44. This results in a composite integral structure having a substantially rectangular cross-section. In FIG. 9, the guide rail 12 is re-positioned to a longitudinal side of the base structure 44, with respect to FIG. 8.

These integrally formed mounting arrangements facilitate the installation process because only a single piece needs to be installed. Further, the guide rail 12 and the rack 8 have a fixed position with respect to each other so that no alignment of these components is necessary.

Figure 10:
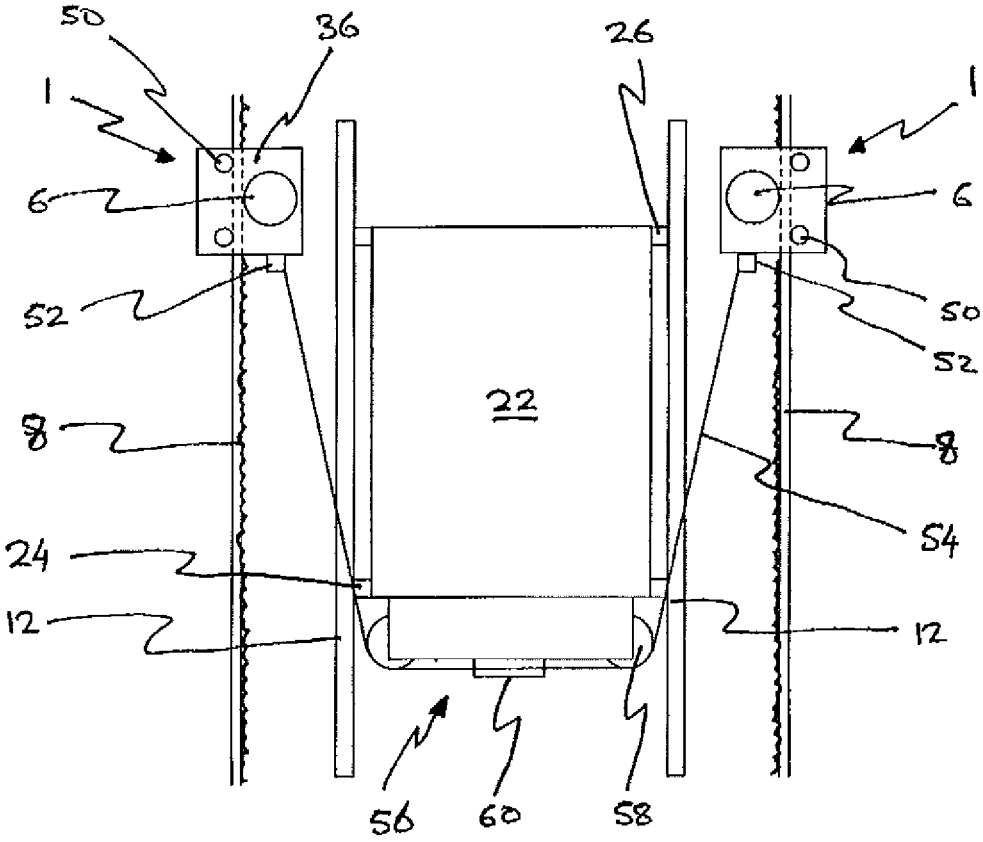
FIG. 10 is a schematic illustration of one embodiment of an elevator utilizing two drives wherein the car is supported on a tension member suspended between the drives.
Figure 11:
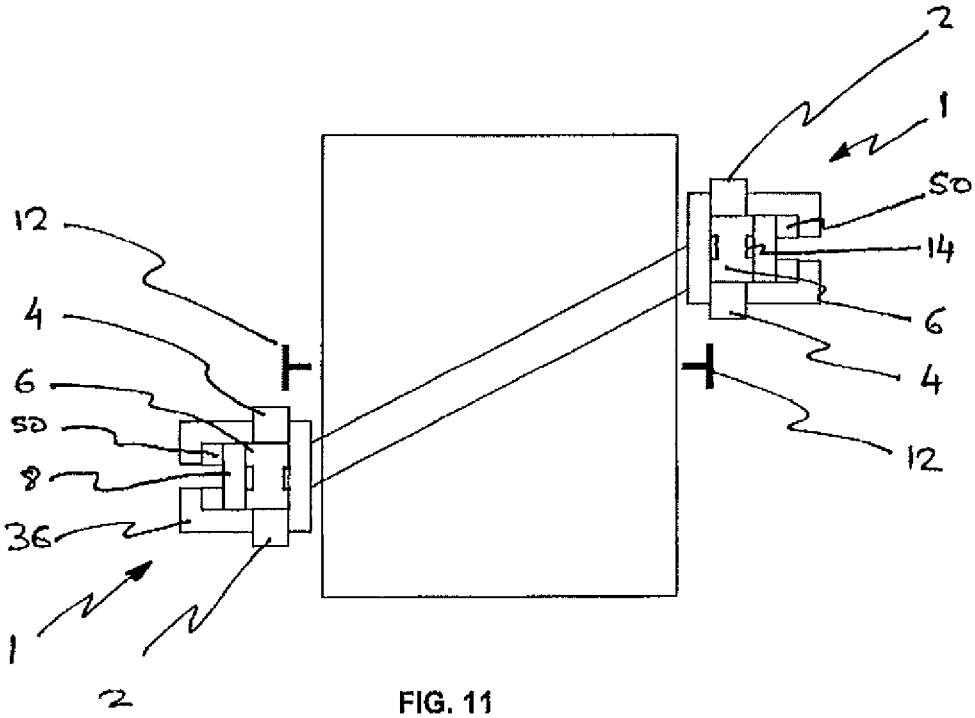
FIG. 11 is a cross-sectional view along a horizontal plane of the embodiment of FIG. 10.
Figure 12:
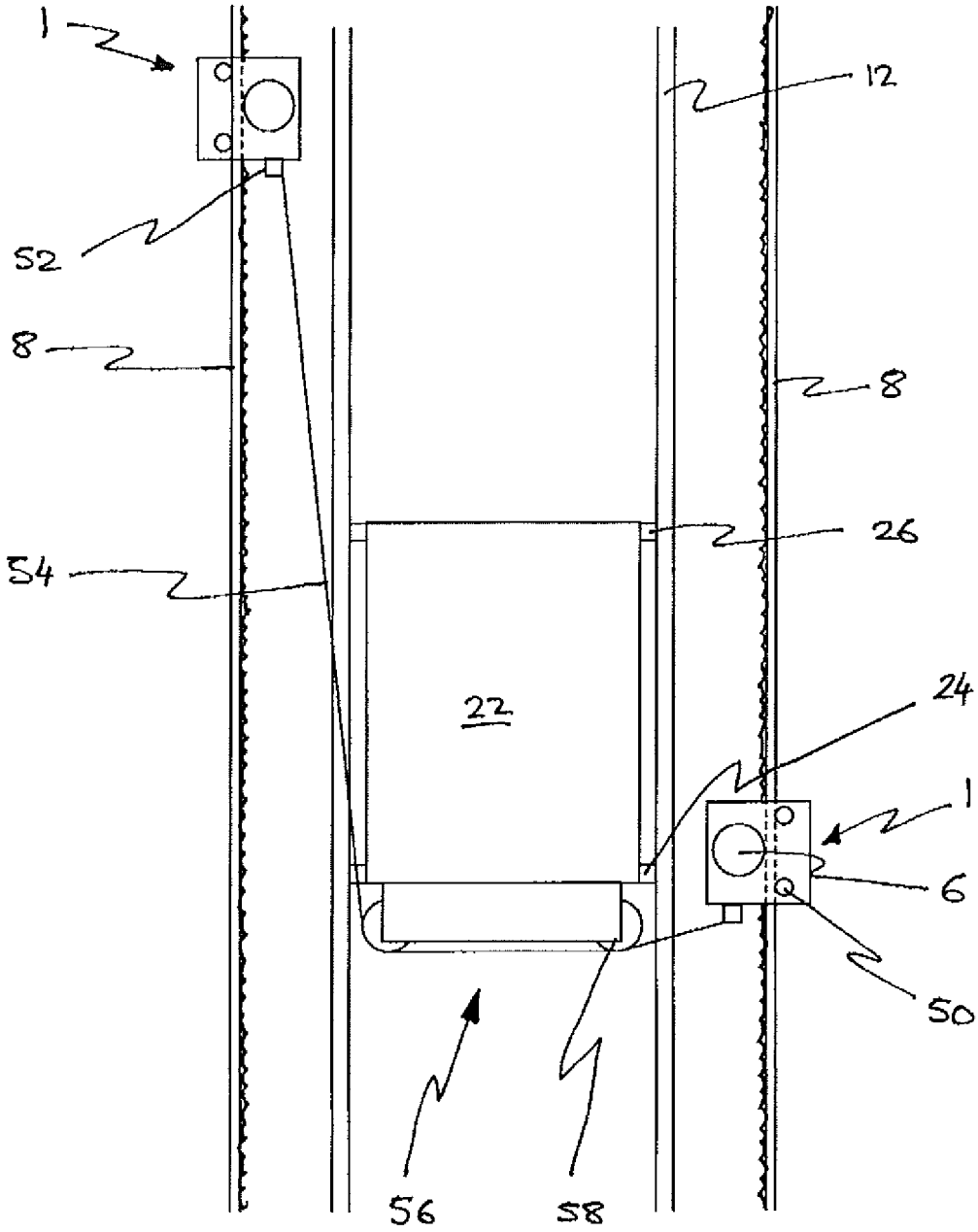
FIG. 12 illustrates the embodiment of FIG. 10 during an evacuation trip.

FIGS. 10-12 illustrate a further embodiment of an elevator wherein a double drive system is employed to elevate and lower the car 22 along the guide rails 12 mounted in the hoistway. This arrangement can be particularly applicable to the modernization of an existing elevator installation where the drive system is replaced, but the existing car guide rails 12 are reused.

The elevator includes two identical drives 1 diametrically arranged to each other on opposing sides of the car 22. Each of the drives 1 is similar to that previously described with reference to FIG. 5 and comprises a brake unit 4, a pinion unit 6 and a motor unit 2 however in this instance the support structure 36 is designed to partially surround the associated rack 8. The pinion unit 6 engages with the toothed profile 14 of the rack 8 to move the drive 1 along the rack 8. Such movement is guided by a plurality of rollers 50 mounted above and below the pinion unit 6 by the support structure 36 at the opposing side of the rack 8 to the pinion unit 6. Possibly, the rollers 50 are resilient so that they not only guide the drive 1 along the rack 8 but also attenuate at least some noise and vibration caused by the engagement of the pins 16 of the pinion unit 6 with the toothed profile 14 of the rack 8 from traveling along the rack 8.

A tension member 54 is suspended between the two drives 1 and attached thereto at fixation points 52. The tension member 54 underslings the car 22. The car 22 is mounted on an underslung pulley box 56 and is guided along its opposing guide rails 12 by upper and lower guide elements 24, 26. The tension member 54 is guided on two deflecting pulleys 58 within the pulley box 56. The pulley box 56 also includes a clamp 60 between the two deflecting pulleys 58. In normal operation the clamp 60 is always closed onto the tension member 54 to couple the car 22 to the tension member 54.

Due to the nature of the engagement of the pinion unit 6 with the toothed profile 14 of the rack 8, in at least some embodiments the drive 1 must be guided along the rack 8 with an accuracy of about 1/10 mm. This degree of guidance precision is generally unpractical for the elevator car 22 since the guide rails 12 are normally manufactured to a 1 mm tolerance. Accordingly, it can be preferable to allow for the inherent small changes in the relative lateral position of between the drives 1 and the car 22 as the elevator travels upwards and downwards within the hoistway. The flexible tension member 54 has sufficient elasticity to absorb these small changes in the relative lateral position.

In normal operation, the drives 1 move simultaneously along their associated racks 8 to raise and lower the elevator car 22 along the guide rails 12 within the hoistway. If, however, there is a malfunction of one of the drives 1 when the car is occupied and positioned between floors in the building, there are two possibilities of controlling the drives 1 so as to lower the car 22 to the neighboring floor and thereby to allow the passengers to alight from the car 22.

In the first such evacuation trip, the clamp 60 remains closed and the brake units 4 of the drives 1 are alternatively released and accordingly the car 22 is gradually lowered under gravity along its guide rails 12. In a second, alternative evacuation trip, the clamp 60 is opened and the brake unit 4 is controllably released for a selected one of the drives 1. Accordingly, the selected drive 1 will move downwards as illustrated in FIG. 12 and the car 22, which is now freely movable via the deflecting pulleys 58 along the tension member 54, will also gradually travel downwards. Once the car 22 is positioned adjacent to a floor the brake unit 4 is reapplied to stop the car 22 and thereafter passengers are permitted to exit the car 22. Optionally, in addition to releasing its brake unit 4, the motor unit 2 of the selected drive 1 could be driven at half speed.

The skilled person will readily understand that the drive 1 of the present embodiment functions in precisely the same manner as that illustrated in FIG. 5 and can therefore be interchanged since the only difference between both embodiments is whether to guide the drive along the rack by means of rollers 50 or a guide shoe 32. Furthermore, in this embodiment the racks 8 are arranged eccentrically whereas the car guide rails 12 are symmetric about the car 22. The skilled person will easily appreciate that the positions of the racks 8 and guide rails 12 can be exchanged. Furthermore, it will be recognized that the pulley box 56 can be mounted on top of instead of beneath the elevator car 22.

Figure 13:
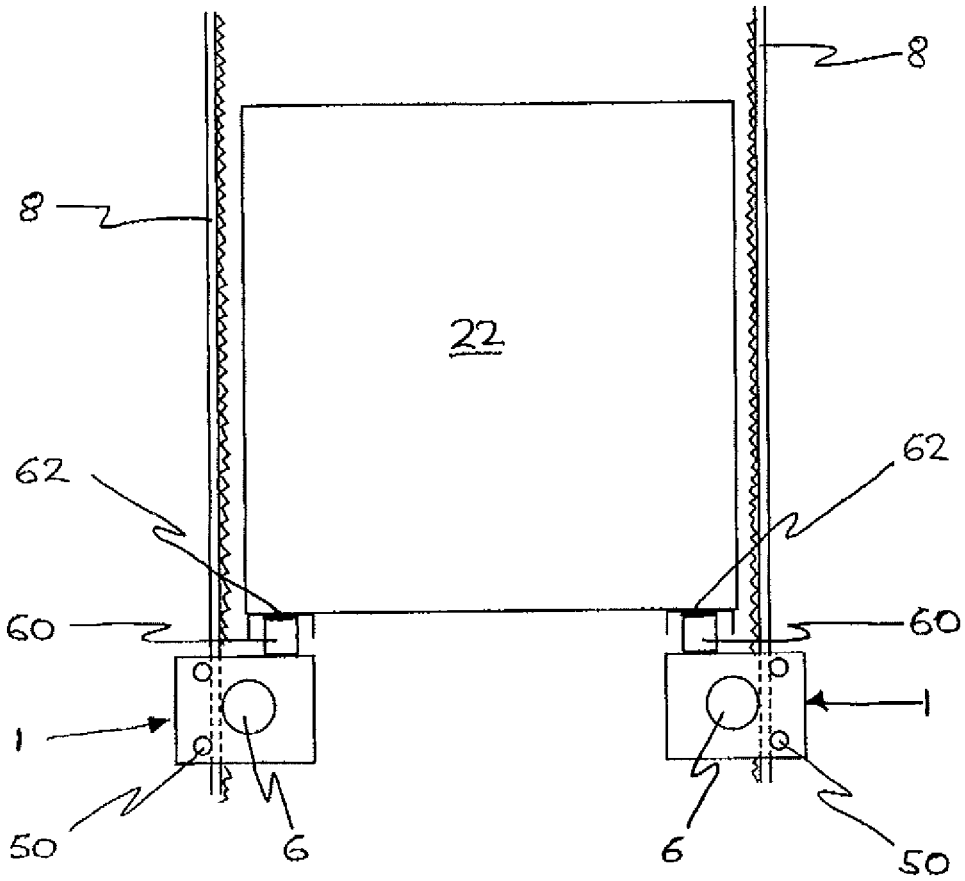
FIG. 13 is a schematic illustration of an alternative embodiment of an elevator utilizing two drives wherein the car is resiliently supported on the drives.

FIG. 13 illustrates an alternative embodiment of an elevator wherein a double drive system is again employed to elevate and lower the car 22 along the guide rails mounted in the hoistway.

The elevator includes two drives 1 (e.g., identical drives) arranged on opposing sides of the car 22. Each of the drives 1 is similar to that previously described with reference to FIGS. 10-12. A resilient element 60 is supported on top of each drive 1 to engage with a slide bearing 62 mounted beneath the car 22. Accordingly, the car 22 is supported via the slide bearings 62 and the resilient elements 60 by the drives 1 and this arrangement allows for the inherent small changes in the relative lateral position of between the drives 1 and the car 22 as the elevator travels upwards and downwards within the hoistway.

Figure 14:
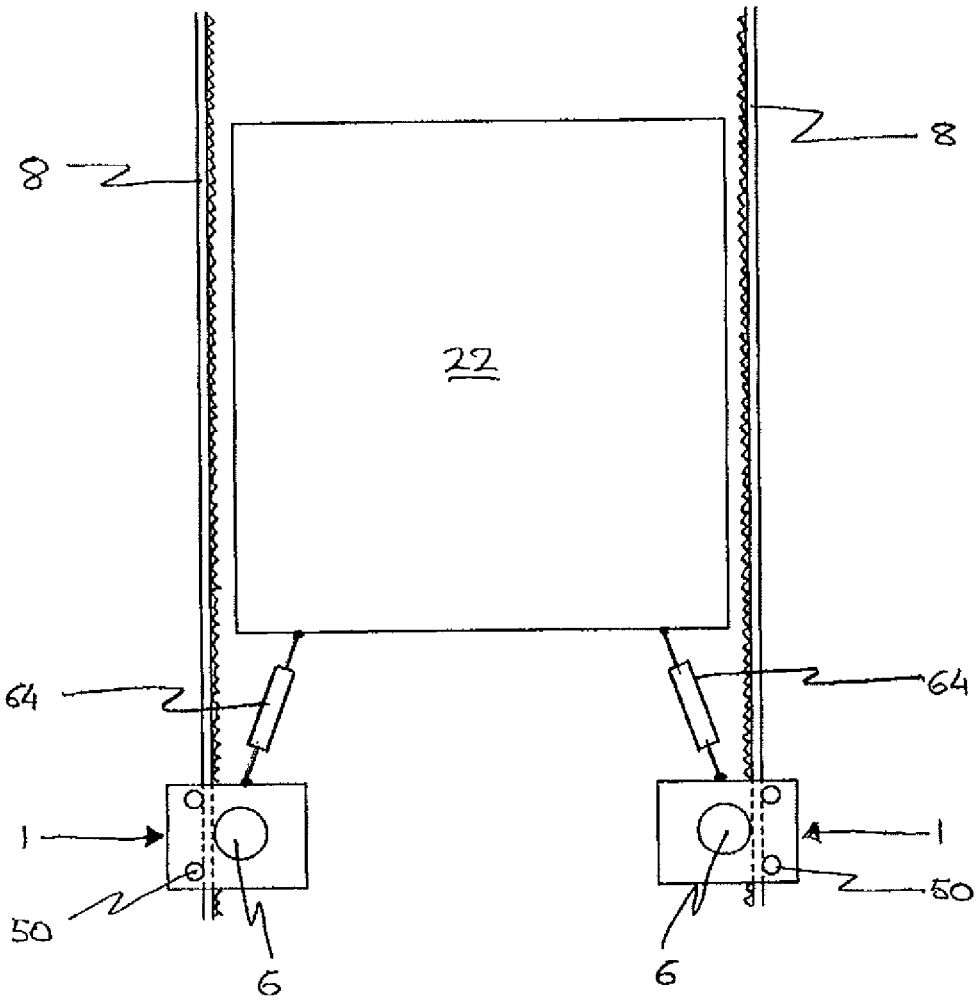
FIG. 14 is a schematic illustration of an alternative to the embodiment of FIG. 13.

In normal operation, the drives 1 move simultaneously along their associated racks 8 to raise and lower the elevator car 22 along the guide rails within the hoistway. If, however, there is a malfunction of one of the drives 1 when the car is occupied and positioned between floors in the building, it is possible to control the drives 1 so as to lower the car 22 to the neighboring floor and thereby to allow the passengers to alight from the car 22. In such an evacuation trip, the brake units 4 on the drives 1 are alternatively released for a very short period of time and accordingly the car 22 is gradually lowered along its guide rails. FIG. 14 illustrates an embodiment wherein the slide bearings 62 and the resilient elements 60 of the FIG. 13 embodiment are replaced by dampers 64 interconnecting the drives 1 with the car 22. Otherwise, both embodiments function in the same way.

In at least some embodiments, one car 22 can be configured to travel in the same hoistway. Such a multi-car elevator system can enhance transportation capacity without requiring additional hoistway space.

Although the disclosed technologies have been described as having particular benefit in the context of elevators without counterweights, it will be appreciated that the drive system is equally applicable to counterweight elevators.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator, comprising:

a car movable within a hoistway;

two racks extending along the hoistway, each rack having a toothed profile with wave troughs and wave crests;

two drives mounted in proximity to the racks so that each drive interacts with one of the racks to move the car, each drive comprising:

a roller pinion unit fixedly mounted on a shaft and having a predetermined number of roller pinions arranged in a circle around the shaft and extending parallel to the shaft, the roller pinion unit interacting with the toothed profile of the rack; and a motor unit configured to rotate the shaft; and a tension member interconnecting the two drives and permitting the two drives to move relative to one another along the racks, wherein the car is supported by a pulley box on the tension member.

2. The elevator of claim 1, further comprising a brake unit configured to act on the shaft.

3. The elevator of claim 2, wherein the roller pinion unit is arranged between the motor unit and the brake unit.

4. The elevator of claim 1, further comprising a guide rail extending along the hoistway.

5. The elevator of claim 1, wherein each drive further comprises rollers engaged with the rack, and wherein the rollers are positioned ahead and behind of the pinion unit along the rack.

6. The elevator of claim 5, wherein the rollers are resilient.

7. The elevator of claim 1, wherein the pulley box is mounted under the car.

8. The elevator of claim 1, wherein the car further comprises a clamp to selectively engage with and disengage from the tension member.

9. The elevator of claim 1 wherein the tension member is flexible.

10. The elevator of claim 1 wherein the tension member permits lateral movement of the car relative to each of the drives.

11. The elevator of claim 1 wherein the tension member permits movement of one of the drives along one of the racks while another of the drives is stopped along another of the racks.

12. A method of operating an elevator, the method comprising:

releasing a brake of at least a selected one of two elevator drives of an elevator while the elevator is trapped between two floors, the elevator comprising, a car movable within a hoistway, two racks extending along the hoistway, each rack having a toothed profile with wave troughs and wave crests, and each drive mounted in proximity to one of the racks so that each drive interacts with the rack to move the car, each drive comprising a roller pinion unit fixedly mounted on a shaft and having a predetermined number of roller pinions arranged in a circle around the shaft and extending parallel to the shaft, the roller pinion unit interacting with the toothed profile of the rack, a motor unit configured to rotate the shaft, and rollers engaged with the rack, and wherein the rollers are positioned ahead and behind of the pinion unit along the rack;

providing a tension member interconnecting the drives and permitting the drives to move relative to one another along the racks;

supporting the car by a pulley box on the tension member; and selectively clamping the car to the tension member by a clamp.

13. The method according to claim 12 further comprising re-engaging the brake of the selected one of the drives and releasing the brake on the other drive.

14. The method according to claim 12 further comprising releasing the clamp.

15. The method according to claim 14 further comprising driving the selected one of the drives along its associate rack at half its rated speed.

16. The method according to claim 12 wherein the tension member is flexible.

17. The method according to claim 12 wherein the tension member permits lateral movement of the car relative to each of the drives.

18. The method according to claim 12 wherein the tension member permits movement of one of the drives along one of the racks while another of the drives is stopped along another of the racks.

* * * * *